United States Patent [19]

Kramer

[11] 4,188,747

[45] Feb. 19, 1980

[54] INFANT PACIFIER COMBINATION

[76] Inventor: Remi T. Kramer, 8661 Delmonico Ave., Canoga Park, Calif. 91304

[21] Appl. No.: 921,202

[22] Filed: Jul. 3, 1978

[51] Int. Cl.[2] ..... A63H 3/00

[52] U.S. Cl. ..... 46/116; 128/360

[58] Field of Search ..... 128/133, 359, 360, 252; 46/116, 171, 117

[56] References Cited

U.S. PATENT DOCUMENTS

| | | | |
|---|---|---|---|
| 2,675,644 | 4/1954 | Senior et al. | 46/117 |
| 2,711,052 | 6/1955 | Brayford | 46/116 |
| 2,860,639 | 11/1958 | Hoover | 128/359 |

*Primary Examiner*—Harry N. Haroian

[57] ABSTRACT

An object or toy, naturally attractive to small children and infants, is provided with a receptacle at an advantageous location for reception of a nipple serving as a pacifier. The nipple in turn is one suitable for being individually sterilized from time to time. The receptacle is therefor provided with a releasable clamp, effectively concealed within the toy, but capable of releasably grasping a smoothly contoured projection on one end of the nipple to hold it in position on the toy from which it can be released at will.

5 Claims, 6 Drawing Figures

INFANT PACIFIER COMBINATION

In the care of infants, it has been common practice to provide the child with some object simulating a nipple of the mother's breast which the child can mouth when not feeding. Although many children are undisturbed during the non-feeding interval, others appear to be not content in the absence of either feeding or simulated feeding. It is also true that occasions may arise when a proper feeding schedule cannot be complied with. A child, anticipating being fed on schedule may become irritable, and even psychologically frustrated unless the feeding is in some way simulated.

Some children even for a period of long after being weaned, continue to anticipate and expect breast or bottle feeding. On occasions psychological problems can arise unless the situation is adequately taken care of.

Pacifiers of rubber-like or plastic material have been commonly used. Quite naturally such objects which are designed to be put in the child's mouth tend to get dirty and unsanitary. Consequently they need to be such that they can be periodically sterilized, or in any event, cleaned. When such pacifier's are small, as they can be, they often get lost or misplaced when dropped by the child and the purpose of the pacifier is not only defeated but the pacifier also is likely to lodge in someplace where dirt has accumulated. Further still, and frequently with older infants and even small children the customary pacifier, although accepted to a degree, may be found inadequate to satisfy the emotional as well as the physical need of the child.

It is therefore among the objects of the invention to provide a new and improved infant pacifier combination which makes it possible to couple a conventional pacifier object with an animal-like doll or toy to which the child can become affectionately attached and at the same time have the infant craving for the breast physically and emotionally satisfied.

Another object of the invention is to provide a new and improved pacifier combination whereby a mechanical pacifier object can be temporarily attached to a doll or animal-like object in such fashion that when the object is embraced by the infant in a natural way, the pacifier is at a location most convenient to the child's needs.

Still another object of the invention is to provide a new and improved infant pacifier combination wherein when the pacifier object is attached to a doll or other animal-like object the attachment means can be adequately concealed and covered both during the time when the pacifier object is attached and also when removed so that whatever may be used as a retaining device for the pacifier object it is located where it cannot readily be damaged nor dirtied.

Still further among the objects of the invention is to provide a new and improved infant pacifier combination wherein a doll or animal-like object is provided with a concealed retaining device for the pacifier object of the type such that the object can be readily removed for cleaning and sterilizing and just as readily replaced either with a comparable pacifier object or with the one initially provided after it has been sterilized, the arrangement being such that whatever the retainer may be which is used for the animal-like object it can in no way harm even the smallest infant.

With these and other objects in view, the invention consists of the construction, arrangement, and combination of the various parts of the device, whereby the objects contemplated are attained, as hereinafter set forth, pointed out in the appended claims and illustrated in the accompanying drawings.

Figure 1:
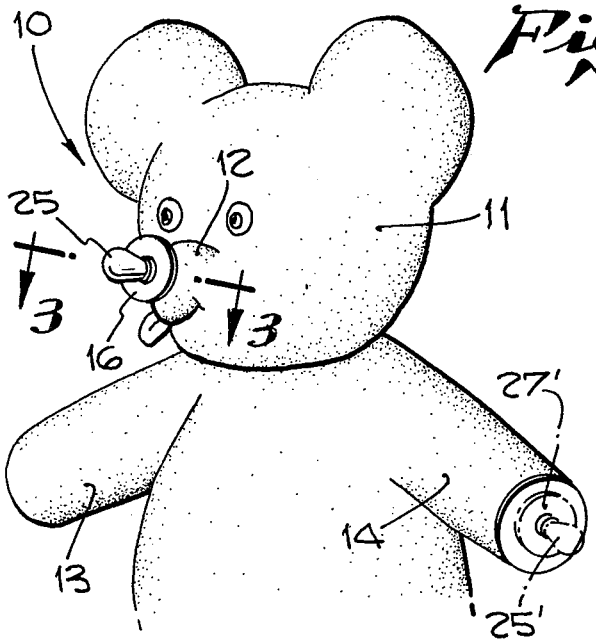
FIG. 1 is a front perspective view of the pacifier combination showing a pacifier object attached to the nose of a doll.
Figure 2:
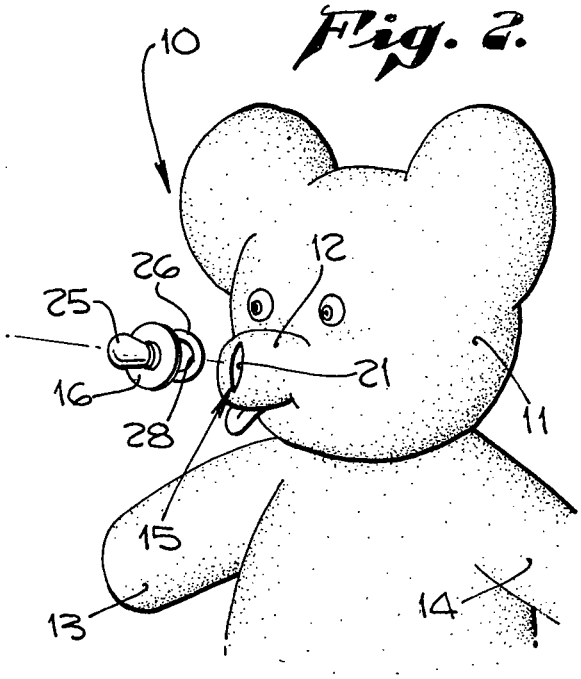
FIG. 2 is a front perspective exploded view similar to FIG. 1 showing the pacifier object removed.

In an embodiment of the invention chosen for the purpose of illustration an animal-like object 10 is depicted here taking the form of a toy bear. The animal-like object could as readily be a lamb, puppy, kitten or in fact any type of doll-like object attractive to infants and which normally may have a soft or fluffy exterior, so that they can be embraced and cuddled affectionately. The animal-like object which is typical is one being possessed of a head 11 with a nose 12 protruding to a degree outwardly from the head. Arms 13 and 14 are also depicted. Variations in the animal-like object are limited only to the imagination of the designer.

In the form of device of FIGS. 1, 2, 3 and 4 the protruberance here depicted as the nose 12 is provided with a receptacle indicated generally by the reference character 15. For convenience the receptacle is in the form of a slit, although the form might vary appreciably depending on the character of pacifier object or member which may be employed.

The receptacle 15 is made relatively deep and is lined with opposite sidewall portions 17 and 18. On the sidewall portion 17 is an adhesive patch 19 while on the sidewall 18 is a complementary adhesive patch 20. The adhesive patches in the chosen embodiment have appreciable area as compared to the area of the sidewall portions 17 and 18. The patches 19 and 20 are of material such that they will readily stick to each other when moved to the relative positions of FIG. 3, but which can be just as readily separated from each other to the positions of FIG. 4. The patches may be provided with pressure sensitive adhesive or some other adhering type of mechanism such as commercially available Velcro. It is of consequence that the adhesive patches 19 and 20 be located far enough within the receptacle 15 so that there is a short space 21 located outwardly with respect to the patches. Preferably also, there is a space 22 at the bottom of the receptacle which is clear of the material comprising the patches.

The pacifier 16 has a nipple 25 at the one end and a retainer counter-member 26 at the opposite side. Separating the nipple 25 and retainer counter-member 26 is an annular flange 27. The nipple is preferably hollow so that it can be readily squeezed by the teeth of the infant user.

Figure 3:
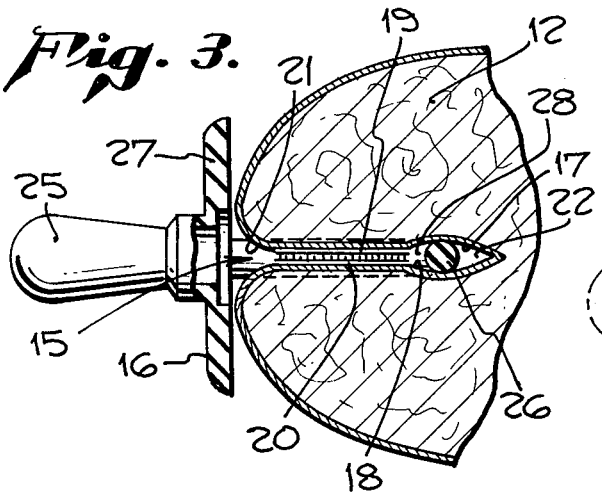
FIG. 3 is a fragmentary sectional view on the line 3—3 of FIG. 1 showing one form of the means of attachment.

In the chosen embodiment the retainer counter-member is in the form of a relatively large ring, which may be of circular cross-sectional shape as shown in FIG. 3. The receptacle 15 having the form of a slit is long enough to freely accommodate the full breadth of the retainer counter-member so that when it is completely received within the receptacle in the position of FIG. 3 the open center 28 of the retainer counter-member will be able to receive the entire area of the adhesive patches 19 and 20 when they are pressed together into engagement with each other. Pressure can readily be applied by reason of the fact that the receptacle is preferably located on some protruberance like the nose 12 which permits opposite sides to be pressed together to engage the adhesive patches. Conversely when the pacifier member is to be removed opposite sides of the projection, like the nose 12 can be grasped and pulled apart thereby to separate the adhesive engagement of the patches 19 and 20 where, when they are separated to the degree shown in FIG. 4 the pacifier member can readily be removed for sterilizing and for replacement either by the same or another comparable pacifier member.

Figure 5:
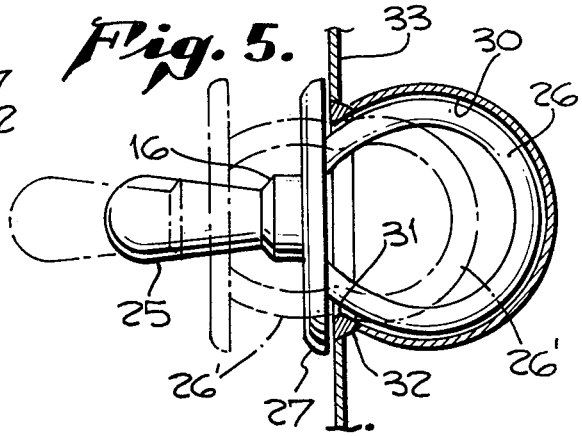
FIG. 5 is a fragmentary sectional view of a modified form of attachment.
Figure 4:
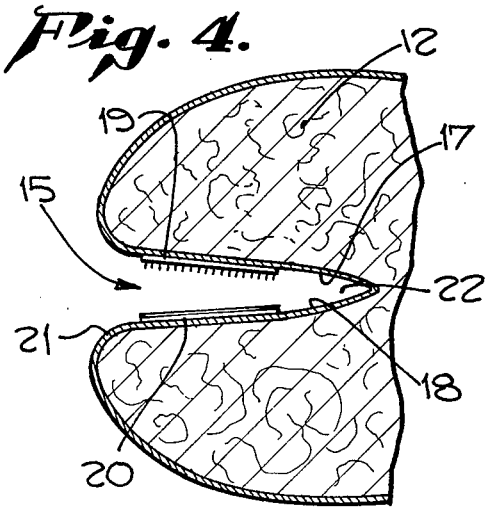
FIG. 4 is a fragmentary sectional view similar to FIG. 3 but with the pacifier object removed.

In the form of device of FIG. 5 the same type of pacifier member is employed but with a receptacle operating on a somewhat different principle. On this occasion the receptacle has an interior pocket 30 large enough to comfortably receive the retainer counter-member 26 when fully extended. The shape of the pocket 30 in a direction at right angles to that shown in FIG. 5 is somewhat arbitrary but can be made only wide enough to freely accommodate the thickness of the counter-member, namely, about as wide as the receptacle 15 when pressed together to the extent shown in FIG. 3. With respect to FIG. 5 it is important to have a perimetrical opening 31 of fixed size and smaller than the fully expanded diameter of the counter-member 26. Because of anticipated wear the perimetrical opening may be buttonholed or provided with some comparable reinforced binding 32 so that it will maintain its size.

When the counter-member is to be employed with a receptacle like that of FIG. 5, it is inserted into the receptacle by squeezing the counter-member to a slightly smaller dimension as shown by the broken line 26′ of FIG. 5. It is necessary to squeeze the counter-member only enough to permit it to pass the perimetrical opening 31 whereafter the counter-member will expand to the solid line position 26 of FIG. 5, drawing the flange 27 close to engagement with a surface 33 of the animal-like object. In this form of device the pacifier member need not be applied to a protruberance needing to be squeezed or pulled apart, but on the contrary can be applied to a relatively extended flat surface.

Figure 6:
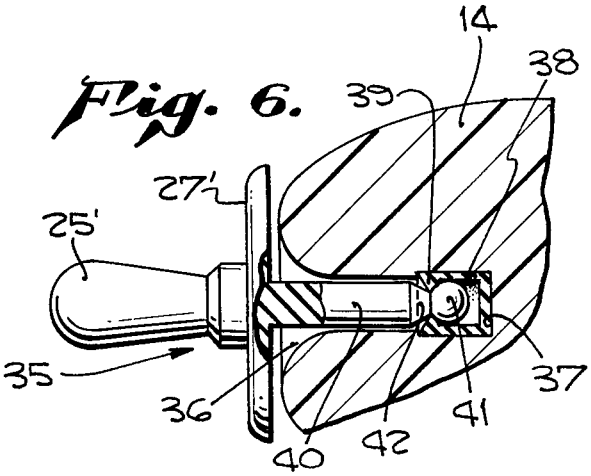
FIG. 6 is a fragmentary sectional view of still another form of attachment.

In the form of device of FIG. 6 it may be assumed merely by way of example that a pacifier member 35 is to be applied at the end of the arm 14, or other comparable protruberance. The receptacle 36 in this instance may be circular in cross section but will in any event be relatively deep to provide a pocket 37. In the pocket is a fitting 38 having elastic properties so as to provide a perimetrical bead 39 close to the bottom of the receptacle 36. In this form of the device on the side of the pacifier member 35 opposite from the nipple 25′ is a post 40 terminating in a knob 41, the post being separated from the nipple 25 by a flange 27′. Between the knob 41 and the post 40 is a recess 42 which is adapted to receive the bead 39 when it contracts, after having been expanded by projection of the knob 41 through the space formed by the bead. In this position as shown in FIG. 6, the bead serves to act against the knob 41 serving as a shoulder thereby to releasably retain the pacifier member 35 in position in the receptacle. When the pacifier member is to be removed it is merely forcably pulled outwardly when again the bead 39 will be expanded temporarily as the knob 41 is pulled past.

Having described the invention, what is claimed as new in support of Letters Patent is as follows:

1. An infant pacifier combination in the form of a doll-like body naturally attractive to and of size for being embraced by a human infant, said combination comprising a body having one or more protruberances, a receptacle located on one of the protuberances, the receptacle being concealed within the body and having wall portions of the body forming an outwardly facing opening for the receptacle and open to the exterior, a releasable yieldable holder in said receptacle and concealed from the exterior, a pacifier member having a nipple like protrusion on one side and a retainer counter-member on the opposite side, a part of the retainer counter-member being complementary with respect to the yieldable holder when said retainer counter-member is located within the receptacle, whereby the pacifier member is held releasably in place on the body.

2. An infant pacifier combination as in claim 1 wherein the holder in the receptacle comprises retention means extending between said wall portions, the retainer counter-member of the pacifier member having an opening therein for reception of the retention means.

3. An infant pacifier combination as in claim 2 wherein the retention means comprises mutually engaging adhesive means extending over oppositely facing wall portions and the opening of the retainer counter-member lies within a ring and has an area exceeding the area occupied by the areas of the wall portions when in engagement.

4. An infant pacifier combination as in claim 1 wherein the holder in the receptacle comprises a perimetrically extending flange of fixed size and the retainer counter-member is laterally yieldable in response to pressure of insertion into said holder and expandable at a location within said flange.

5. An infant pacifier combination as in claim 1 wherein the holder in the receptacle comprises a substantially perimetrical bead of yieldable material and the retainer counter-member comprises a knob greater in transverse dimension that the transverse dimension of the bead and a recess adjacent the knob adapted to receive at least a portion of the bead when the retainer member is located within said receptacle.

* * * * *